US005472407A

United States Patent [19]

Schenck

[11] Patent Number: 5,472,407

[45] Date of Patent: Dec. 5, 1995

[54] MOTORIZED DYNAMIC TRACTION DEVICE

[76] Inventor: Robert R. Schenck, 1100 N. Lake Shore Dr., Chicago, Ill. 60611

[21] Appl. No.: 135,904

[22] Filed: Oct. 13, 1993

[51] Int. Cl.[6] ..... A61H 1/00

[52] U.S. Cl. ..... 601/40; 602/22

[58] Field of Search ..... 482/44–48, 124; 601/40; 602/21, 22, 32, 36, 37

[56] References Cited

U.S. PATENT DOCUMENTS

| | | |
|---|---|---|
| 2,353,129 | 7/1944 | DeMona . |
| 3,020,908 | 2/1962 | Daniels et al. . |
| 3,457,912 | 7/1969 | Clark et al. . |
| 3,714,940 | 2/1973 | Palmer . |
| 3,756,222 | 9/1973 | Ketchum . |
| 3,769,970 | 11/1973 | Swanson . |
| 4,487,199 | 12/1984 | Saringer . |
| 4,537,083 | 8/1985 | Saringer . |
| 4,576,148 | 3/1986 | Koerner et al. . |
| 4,607,625 | 8/1986 | Schenck . |
| 4,644,938 | 2/1987 | Yates et al. . |
| 4,665,900 | 5/1987 | Saringer . |
| 4,716,889 | 1/1988 | Saringer . |
| 4,724,827 | 2/1988 | Schenck . |
| 4,772,012 | 9/1988 | Chesher . |
| 4,875,469 | 10/1989 | Brook et al. . |
| 4,945,902 | 8/1990 | Dorer et al. . |
| 4,962,756 | 10/1990 | Shamir et al. . |

FOREIGN PATENT DOCUMENTS

| | | | |
|---|---|---|---|
| 296618 | 10/1929 | Germany . | |
| 1766400 | 10/1992 | U.S.S.R. ..... | 602/21 |

OTHER PUBLICATIONS

Ketchum, et al., The Journal of Hand Surgery, vol. 4, No. 5, Sep., 1979, pp. 476 and 477.

Caus, et al., Research Digest—Dundee Institute of Technology, 1990–1992 pp. 10–11.

Sutter Biomedical, Inc. (Product Literature) "Sutter CPM™ 5000", San Diego, Calif.

Toronto Medical Corp. (Product Literature) "Mobilimb™ Hand CPM Units" (1984).

*The Journal of Hand Surgery,* vol. 11A, No. 6, Nov., 1986, p. 851.

*Primary Examiner*—Richard J. Apley
*Assistant Examiner*—Jeanne M. Clark
*Attorney, Agent, or Firm*—Fitch, Even, Tabin & Flannery

[57] ABSTRACT

In accordance with the present invention, there is provided a portable hand mounted device for tractioning a finger having a fractured bone and at the same time continuously flexing and extending the joint to which the fractured bone is proximally attached in order to prevent joint deterioration. More particularly, the device may be made in an inexpensive manner by medical personnel and is a light, less cumbersome device than that in the prior art. A drive motor is carried by a cast-like support which is attachable to the forearm and hand for substantially immobilizing the wrist joint and joints of the hand proximal to the joint which is immediately proximally connected to the broken bone. The support carries a frame or hoop defining a substantially arcuate path of motion for carriage travel while flexing and extending the joint of the fractured finger. The carriage rides on the hoop first in one direction and then in the other direction along the arcuate path. The carriage is driven by an elongated, flexible yet stiff cable mounted for travel in a guide in the hoop with one end of the cable connected to the drive motor to push and pull the cable in the groove and to reciprocate the carriage. Elastomeric bands tension the broken finger to the carriage so that the finger joint follows the reciprocating carriage to first extend the finger, bending occurring primarily at the proximally connected joint.

3 Claims, 4 Drawing Sheets

25
44
46
40
31
52
60
58
56
62
64
54

142
133
131
125
132
150
138
131
150
133
140
141
141
134
130
144
136
151
144

MOTORIZED DYNAMIC TRACTION DEVICE

FIELD OF THE INVENTION

The present invention relates to devices for holding a finger with a fractured phalanx under traction and at the same time flexing the joint or joints to which the fractured bone is connected to prevent joint deterioration.

BACKGROUND OF THE INVENTION

It has long been known to place fractures, particularly comminuted fractures, under distal fraction. Otherwise, compressive forces exerted on the healing bone will tend to collapse the bone. For healing comminuted finger bones (phalanxes), devices are in use which are attached to the arm and which hold the finger immobilized under distal traction.

One noted consequence of phalangeal fracture and the subsequent healing process is deterioration of cartilage tissue in the joints to which the fractured bone is connected, particularly the joint immediately proximal to the fractured bone. There is good medical evidence to suggest that the cartilage deterioration is, to a significant degree, a result of extended immobilization of the joints.

A number of studies relating to joint disorders suggest the value of subjecting injured or diseased joints to passive motion, which preferably is continuous. For example, Robert Salter, et al., Clinical Orthopedics and Related Research, No. 159, September, 1981, pp. 223–247, describe the beneficial effects of continuous passive motion on living articular cartilage in acute septic arthritis. Richard H. Gelberman, et al., The Journal of Bone and Joint surgery, 65A, pp. 70–80 (1983) describe the benefits of controlled motion in flexor tendon healing and restoration. As a result of such studies, various devices have been proposed to provide passive motion to damaged or diseased joints. These devices provide motion to phalangeal joints that are adjacent to fractures so as to afford the benefits which have previously been afforded to damaged or diseased joints, and at the same time, holding the fractured phalanx under distal traction. Movement has been found to assist in joint cartilage surface regeneration.

In order to accomplish such object, it is known to employ one such device that involves a splint having a substantially arcuate frame about which a motorized carriage travels for continuously flexing and extending phalangeal joints for joint healing and joint therapy. In such device, the fractured finger is attached to the motorized carriage under traction, and while being under traction, the carriage is reciprocated back and forth about the frame. An example of such device is disclosed in U.S. Pat. No. 4,607,625 issued to Robert R. Schenck.

Such device is highly effective in the healing and maintaining the anatomical structure of fractured phalanxes. However, it is further desirable to provide this type of healing and joint therapy with a device that tends to be more suitable for custom adaption to a particular patient. The aforementioned patent discloses a motor mounted for travel along an arcuate track in a circular hoop or ring. Motors are relatively heavy and their position substantially outward of the person's fingertips makes the device feel very heavy and very awkward to the wearer. Cost of the device is particularly relevant. Some companies will only lease the devices for use at relatively high cost per usage.

It is the primary object of the present invention to provide a device which is inexpensive and can be sized on a particular patent basis to increase the comfortability and portability of the device. In this connection, the present invention is directed to a device which accomplishes the desired healing and therapeutic results while enhancing transportability. In particular, the present invention focuses on the reduction of the device's weight and awkwardness through the reduction of the frame size and the design and positioning of the device's means for reciprocating the carriage for flexing the joints.

Another objective is to provide a dynamic traction device which alternately flexes and bends a fractured joint, and yet which is highly durable, efficient and cost effective to manufacture, install and operate.

SUMMARY OF THE INVENTION

In accordance with the present invention, there is provided an improved dynamic traction device with an arcuate dynamic traction carriage to flex and extend a damaged finger joint. The present invention pertains to an improved portable hand mounted device for tractioning a finger having a fractured bone and at the same time continuously flexing and extending the joint to which the fractured bone is proximally attached in order to prevent joint deterioration and to assist in joint cartilage regeneration. The preferred device is lightweight and less awkward to use because the motor is mounted at the wrist of the user and drives a flexible stiff cable actuator guided for reciprocating movement on the ring.

In the preferred embodiment, a support means, or cast-like structure, is attached to the hand and arm of the patient. A hoop-shaped frame is mounted from the support means and includes an arcuate outer surface and an arcuate internal groove extending in a path which is substantially in the plane of natural flexing and extension of the fractured finger, outward of the tip of the finger and with the joint proximally connected to the fractured bone substantially at the radial center of the path. A carriage means travels about in a reversible path about the hoop. A band means, such as an elastic band, holds the finger, at a location distal to the fractured bone, to the carriage under traction.

Means are provided for reciprocating the carriage about the arcuate surface on the hoop. The reciprocation movement is first in one direction about the surface and then in an opposite direction to alternately flex and extend the proximal joint as the bone heals under traction. The passive movement provided to the proximal joint help to preserve joint tissue and to assist in joint cartilage regeneration. An elongated connecting member extends and moves within the arcuate groove to move the carriage means through an attachment means.

More particularly, the frame further comprises a hoop-shaped body defined by the arcuate outer surface with the groove extending from the arcuate outer surface towards the center of the body, and the arcuate outer surface having a pair of carriage traveling surface regions disposed symmetrically on each side of the groove upon which the carriage travels. The carriage means is connected to the elongated connecting member for movement therewith, and the carriage means includes a pair of rollers mounted to the attachment means for rotation about an axis of rotation tangential and perpendicular to the frame. The rollers roll back and forth along the hoop-shaped body. The reciprocating means includes a drive motor that is capable of continuously effectuating movement of the carriage in the first and second directions. The drive motor is attached to the support means at a location adjacent the arm of the patient for convenient transport.

One advantage of the device's design includes being able to custom size the hoop-shaped frame. The latter may be formed from a flexible elongated member of a particular length, depending on the anatomy of a particular patient's hand and the desired arcuate movement with respect to the fractured hand. The elongated member is made of a certain material thermoplastic material that can be readily formed into a hoop and attached to the cast-structure.

DETAILED DESCRIPTION OF THE DRAWINGS

The present invention will be described in connection with the accompanying drawings, which illustrate the preferred embodiments and details of the invention, and in which.

DETAILED DESCRIPTION OF THE PREFERRED EMBODIMENT

Figure 1:
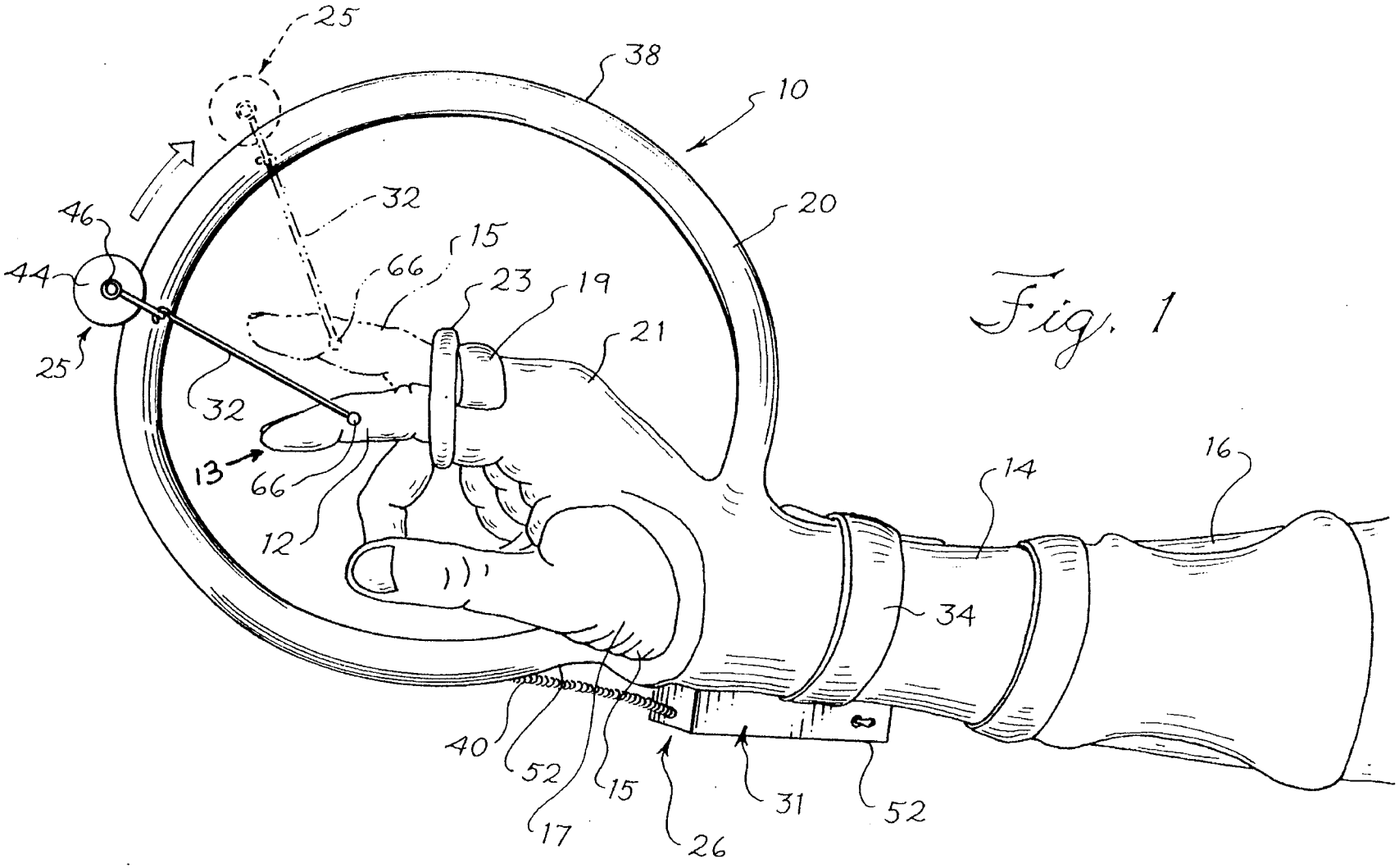
FIG. 1 is a side view of a device, embodying various features of the present invention, affixed to the forearm and hand of a patient and holding a fractured finger under dynamic tension.

As shown in the drawings for purposes of illustration, the present invention provides a device 10 for holding a fractured phalanx 12 or an interphalangeal fracture under dynamic traction. That is, the device 10 holds the bone 12 under distal tension or traction while at the same time, the device passively bends a joint 15 or joints to which the bone is connected in a generally normal manner between a flexed and an extended position during at least one phase of bone healing. The passive motion, which preferably is continuous during the healing phase, protects the joint against cartilage deterioration that is known to frequently accompany healing of phalangeal interarticular fractures. Also, for interphalangeal fractures the tension forces may relieve compressive forces distorting congruity and cause particular ligaments to reposition the bone fragments back into anatomical position.

In particular, the present invention provides a wearable portable device which is worn on the hand and forearm of the patient for holding the finger with the fractured bone under dynamic tension and for movement during healing. The device 10 is worn on the hand 17 and forearm 16 of the patient for holding the finger 13 with the fractured bone 12 under dynamic tension during healing. Since the device is employed to aid in healing the hand, it is desirable that the device be manageable for transport.

While the device shown in U.S. Pat. No. 4,607,625 provides the desired flexion and traction of the finger, it can be improved by reducing the size of the hoop and amount of weight felt by the wearer which is principally due to the motor being carried on the hoop at a location several inches outward of the wearer's fingertips. The formation of cog track for the motor on the hoop also adds considerably to the cost on the hoop. Medical personnel are familiar with hoops being attached to the hand in a non-motorized or passive mode and many medical personnel have made such hoops from thermoplastic sheets or bars such as those sold under the trademark POLYFORM® by Smith and Nephew and Roylan Incorporated of Menomenee Falls, Wisconsin. A particular problem arises of how to provide an inexpensive manner of pushing and pulling the carriage about the hoop in an inexpensive and simple manner and in a lightweight, less awkward and less bulky manner.

In accordance with the present invention, the hoop 20 is formed from a piece of plastic with a groove 36 in it and the hoop 20 guides an arcuate, stiff but flexible actuator cable 40 that has one end connected to a carriage 25 and the other end connected to a motor 31, which is mounted by a cast 14 on the wearer's forearm 16 at the wrist. The preferred carriage travels along the exterior surface of the hoop and is connected by rubber bands 32 or the like to the finger joint. As the motor rotates, the cable is pushed outwardly from the wrist to extend the finger and then the cable is stopped and reversed in a downward direction toward the wrist to bend and flex the finger joint while it is under traction. Preferably, the hoop 20 with the groove in it will be made on site by taking a straight piece of Polyform thermoplastic and placing it in hot water at a temperature of 150° to 160° and making the hoop of a size customized to the size of the person and/or hand being used. The use of such a plastic hoop, an inexpensive cable for push-pulling, and an inexpensive carriage and rubber bands driven by a wrist-mounted motor, results in a inexpensive device compared to current devices which are often leased because they are too expensive to be purchased in many instances. Thus, the present invention is further directed to providing means for generating the passive motion in connection with a frame, which when combined, tends to increase the device's custom adaptability on a particular patient basis to increase the device's overall comfortability and portability during use.

The device includes a support means, such as a splint or half-cast 14, which is securable to the forearm 16 and the hand 17 for holding the wrist joint 18 substantially stationary relative to the forearm and immobilizing other joints of the hand 17, particularly hand and finger joints proximal to the fractured bone.

Immovably connected to the cast 14 is a frame or hoop 20 which is positioned by the cast in surrounding relationship to the broken finger 13 to define a substantially arcuate path or locus that is generally in the plane of natural bending of the broken finger, substantially outward of the finger tip, and with the joint 15, to which the fractured bone 12 is immediately proximally connected, generally at its radial center. An actuator means for moving the tractioned finger comprises, in this embodiment of the invention, a carriage 25 which is movable about an outer surface 30 of the frame 20. The actuator means includes a driving means 26, such as an electric motor 31, spring motor, etc., which moves the carriage 25 about the outer surface 30. The motor 31 is able to supply the carriage with continuous reciprocation about the surface 30. Means, such as an elastomeric band or bands 32, are secured between the broken finger 13, at a location distal to the fracture, and the actuator means for holding the finger 13 so that it follows the reciprocating arcuate travel of the actuator means.

As illustrated in the preferred embodiment, the device 10 secures to the hand 17 and forearm 16 using a conventional type half-cast 14 which holds the wrist joint 18 substantially immobile to keep the hand 17 linear relative to the forearm 16 and to immobilize various hand and fingers joints, as required. The half-casts are pre-formed of a polymeric material in a variety of sizes for fitting a variety of hand and arm sizes. The illustrated half-cast 14 is held to the forearm and hand by fabric loop fasteners 34, such as those sold under the tradename "Velcro"; however, other fastening means, such as straps, may be employed as well.

The pre-formed half-cast has the advantage of being relatively lightweight and provides aeration of the skin of the arm to prevent sores from developing. Furthermore, the half-cast gives some freedom of movement to the portions of the hand which are not broken during healing. In circumstances where greater stability is required, a more rigid, entirely encircling cast might be used instead. For instances, the hoop 20 may be pre-attached to a support plate or the like which is then wrapped in plaster-impregnated cloth to form a conventional hard-set cast that supports the ring-shaped frame.

As illustrated in FIG. 1, the description of the device 10 presumes a fracture of the middle phalanx 12 of the middle finger 13 and that it is the proximal interphalangeal joint 15 which would be most subject to deterioration. Thus, joint 15 is in need of continuous passive motion to prevent or minimize cartilage deterioration and to assist in joint cartilage surface regeneration. In the illustrated embodiment, the cast 14 of the device 10 further includes a support protrusion 19 which extends behind the proximal phalanx 21 of the middle finger 13 for splinting the same and a fabric loop fastener 23, which is secured to the support protrusion 19 and extends around the proximal phalanx 21 to immobilize it while leaving the proximal interphalangeal joint 15 free to bend. The connection to the finger 13 is distal to the fracture and to the joint which is desired to be flexed. The protrusion 19, which splints the proximal phalanx 21, may be angled from the rest of the cast to hold the metacarpal-phalangeal joint some what bent, e.g., up to an angle of about 70 degrees.

The cast 14 and the hoop 20 are constructed so that the hoop is in the plane of natural bending of the middle finger 13 and with the proximal interphalangeal joint 15 of this finger generally at the radial center of the hoop 20. Relatively minor modifications of the cast to dynamically traction other fingers or to provide for bending of other interphalangeal or metacarpal-phalangeal joints according to the anatomy of the patient are considered to be within the scope of the invention.

The hoop 20 extends from the cast 14 just below the wrist joint 18 from the front side of the forearm 16 to the rear side. The hoop 20 may be constructed from thermoplastic material with sufficient rigidity and structural strength. In the illustrated device 10, the cast 14 and hoop 20 may be molded as an integral unit, or the frame may be readily attached to the cast. The hoop 20 of the present invention is capable of being readily custom fitted and sized on a relative basis for a particular patient. This customization increasingly provides the patient with a device that is less bulky to wear, thereby making the device more comfortable and convenient to user, use and transport. For customization of the device 10, the preferred hoop 20 may be formed from different lengths of stock depending on the requisite diameter and arcuate radius of travel required for a particular patient's finger. The desired diameter of the hoop and the desired arcuate path depends on a number of factors such as the range of motion and the forearm, hand and finger size of the particular patient, considered by the physician.

In order to customize the device 10, the hoop 20 initially is in the form of a flexible, elongated bar that is placed in a water heated to a particular temperature such as 150°–160° F. The preferred plastic material is sold under the brand name "Polyform" thermoplastic and is heated to between 150°–160° F. The basin holding the heated water has a specific circular shape defining the desired arcuate configuration of the hoop 20. Once the hoop 20 is flexed and placed in the basin, it is cooled to maintain the desired hoop-like configuration given to it by the basin.

For example, to provide a 90 degree arcuate range of motion for the fractured finger, the preferred elongated member may have an approximate cross-section diameter of 2.0 inches and varying length values. For instance, an elongated member of about 18.85 inches forms an arcuate hoop having a diameter of about 6 inches. As a result, the carriage would travel along approximately a 4.71 inch excursion of this hoop for a 90 degree range of motion. Thus, as a result of the frame being made from a material which is easily custom fitted, the hoop size can be readily adapted to fit the anatomical characteristics of the particular patient. This tends to reduce the unnecessary bulkiness of the device on an individual patient basis; thus, making the device more comfortable and convenient to wear, use and transport.

Figure 2:
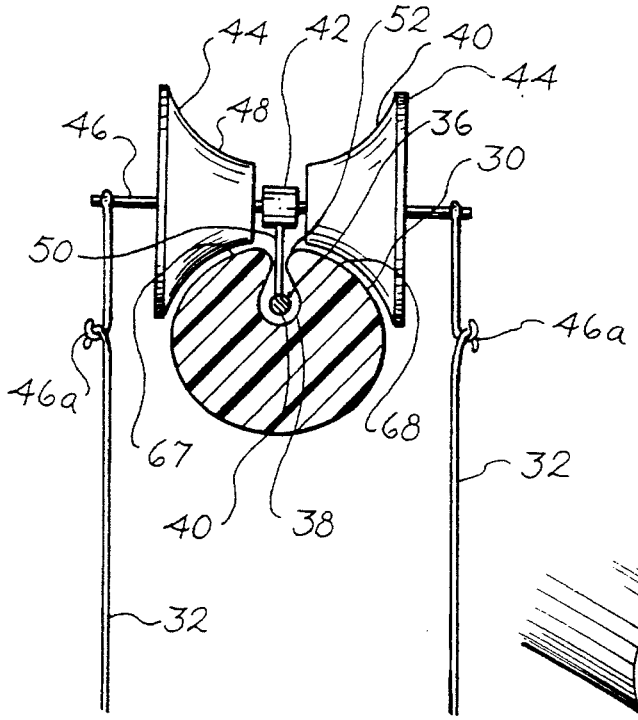
FIG. 2 is an enlarged cross-sectional view of the ring member or frame for illustrating a front elevational view of a carriage of the device of FIG. 1.
Figure 3:
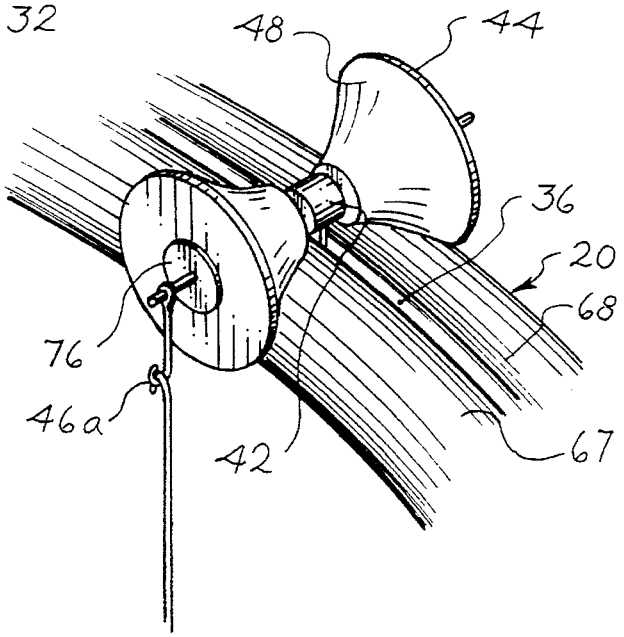
FIG. 3 is an enlarged perspective view, partially cut away, of a portion of the ring member or frame and carriage of the device of FIG. 1.

As best illustrated in FIGS. 2 and 3, the hoop 20 includes a groove 36 opening to the outside of the frame 20. The groove 36 has tear-dropped configuration, as viewed in cross-section, with the bottom portion 38 of groove 36 defining an arcuate path for a cable 40 therein, and accordingly configured to maintain the cable 40 in a manner so that it may reciprocate within the groove 36 to move the carriage 25 precisely, smoothly and continuously over the outer surface 30 of the hoop 20.

The body of the carriage 25 consists primarily of a fixed central component 42 attached to the cable 40 and a pair of rollers 44 mounted for rotation to the fixed central component 42. An attachment member 50 rigidly attaches the central component 42 to the cable 40. The attachment member 50 provides for precise movement of the carriage 25 in response to the cable 40. Thus, the groove 36 has an upper entrance opening 52 that has sufficient width to enable the attachment member 50 to travel freely therebetween its upper sides 67 and 68. The upper sides 67 and 68 however are distanced so not to allow the cable 40 to escape from the groove 36. The cable may be forced through the entrance opening 52 or openings may be provided to allow a threading of the cable into the groove 36.

Each of the rollers 44 are mounted to the central component 42 by a common axle 46 which extends through the central component 42. Each of the rollers 44 include an outer arcuate surface 48 which complements the outer surface 30 of the frame 20 in order to allow the carriage 25 to reciprocate in response to the cable 40. In particular, the rollers 44 are spaced from the central component 42 so to symmetrically straddle the frame 20 over the groove 36 for intimately riding on the outer surface 30 and are maintained on the axle 46 by a lightweight fastener 76. The length of the attachment member 50 is sufficient to allow the rollers 42 to roll freely, but short enough to maintain the roller surfaces 48 in relative contact with the outer surface 30 of the hoop 20.

The illustrated manner of attachment of the bands 32 to the carriage is to form the axle 46 with a pair of integral depending hooks 46*a* (FIG. 2) with the radially outer ends of the bands 32 hooked onto the hooks 46*a*. The bands are in tension, and therefor, apply inwardly-directed force to the axle at spaced positions that tend to pull the axle 46 and the rollers 44 down against the outside of the hoop to give greater stability to the carriage.

Figure 4:
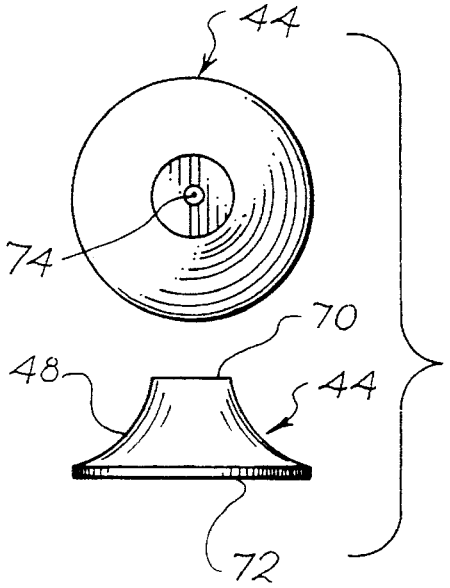
FIG. 4 is an enlarged elevational view and plan view of a roller employed in the carriage of the device of FIG. 1.

As illustrated in FIG. 4, each of the rollers 44 has a generally frusto-conical configuration, as viewed in elevation, defined by the continuous arcuate, conical rolling surface 48 and an inner circular planar surface 70 and an outer circular planar surface 72. A centrally located opening 74 extends through the roller 44 from the inner surface 70 to the outer surface 72 for receiving the axle 46. The opening 74 of each roller 44 has a diameter which allows the roller 44 to rotate with minimal resistance for smooth action without wobbling.

The carriage 25 is intended to move very slowly, a reciprocal cycle in the range of between about one minute to about sixty minutes, or even to every four hours, being contemplated, and accordingly, the motor 31 that drives the cable 40 in the groove 36 for reciprocating the carriage 25 may be very low power. Low power electrical motors are commercially available that are suitable for driving the cable 40 to reciprocate the carriage 25 and which carry self-contained electrical cells. The embodiment of the present invention requires either a reversible motor or a linkage between the motor and the carriage 25 which continuously shifts the direction of cable movement about the surface 30 of the frame 20.

Figures 5, 6:
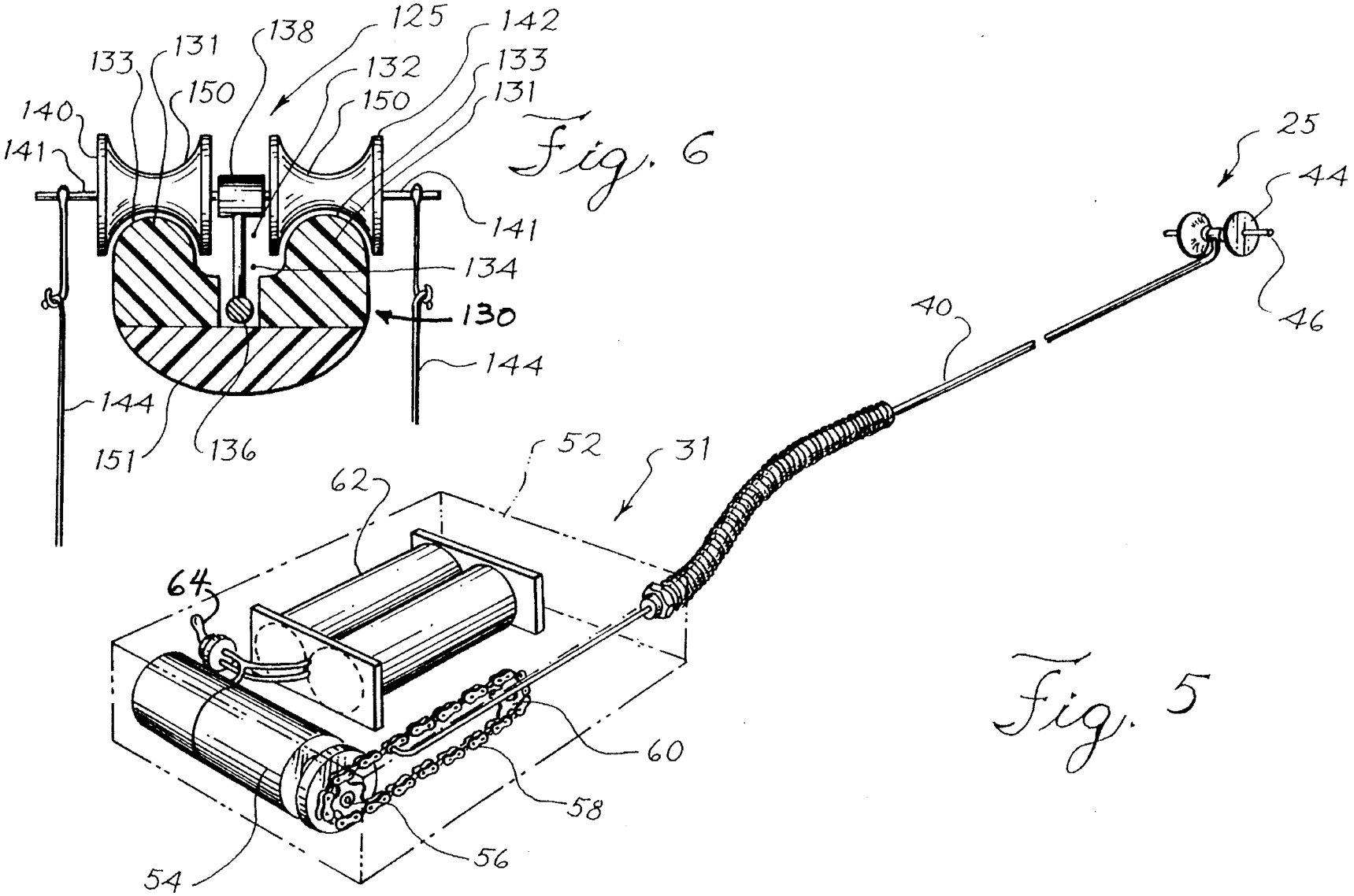
FIG. 5 is perspective view showing a motor mechanism inside a housing of FIG. I with the housing removed and its position shown in dotted lines.
FIG. 6 is an enlarged cross-sectional view of an alternative embodiment for a ring member or frame for illustrating a front elevational view of an alternative embodiment for a carriage in accordance with the present invention.

For example, as shown in FIG. 5, the motor 31 includes a lightweight rectangular block-shaped hollow body 52 which is adapted to be attached to the cast 14 with the fastener 34 and for housing the various components of the motor 31. A geared motor drive 54 drives a first sprocket 56 about which there is a chain 58 which is also about a second sprocket 60 spaced from the first sprocket 56. The cable 40 is attached to one of the links of the chain 58 for effectuating reciprocal motion. Batteries 62 are provided within the body 52 for energizing the geared motor drive 54 along with an operating switch 64. The geared motor drive 54 drives the chain 58 continuously and smoothly in one rotational direction, such as a clockwise direction, so that the cable 40 moves in a first linear direction along the top run of the chain 58 and then down along the bottom run to move the cable 40 in a second, opposite linear direction. The effect of this movement is to provide substantially continuous reciprocating movement to the cable 40 and the carriage 25 for ultimate movement of the joint 15. That is, the carriage 25 is driven continuously, first in a counter-clockwise direction to extend the finger 13 until fully extended and then in the clockwise direction to flex the finger 13. Depending on the diameter of the particular frame, the first and second sprockets 56 and 60, along with the length of the cable 40, are coordinated so as to provide the proper arcuate range of motion for the finger 13.

As stated previously, the elastomeric bands 32 exert a traction force between the finger 13 and the carriage 25 with each of the bands 32 extending directly from the hooks 46*a* at the ends of the axle 46 about which the rollers 44 rotate, as illustrated in FIGS. 2 and 3, to the fractured finger 13. The preferred means for connecting the elastomeric bands 32 to the finger 13 is to have a pin 66 implanted through the finger 13 in a surgical procedure in which a hole is drilled through the bone and the pin 66 inserted. The surgically inserted pin 66 extends from both sides of the finger 13, providing for attachment of an elastomeric bands 32 along each side of the finger 13 to the hooks 46*a* of the carriage axle.

The pin 66 may be inserted through the fractured bone itself, distal to the fracture as shown, or may be inserted through the bone that is immediately distal to the fractured bone. Pin placement depends on factors to be determined by the physician, such as the type and location of fracture. As an alternative, a hook may be glued to the fingernail and the band attached to this hook. Another manner of attachment is to use a special adhesive tape to tape hooks to the finger and to connect these hooks to the bands. Having a band extend along both sides of the finger, as illustrated, helps to stabilize the finger in the plane of its flexing.

The amount of the tension placed upon the finger 13 is determined by the nature and degree of stretching of the elastomeric bands 32. Essentially, the bands are like ordinary rubber bands; however, they are preferably formed of a more stable material, which will not wear out and snap when worn by the patient. This tension also assists in maintaining the rollers 44 of the carriage 25 in contact with the outer surface 30 of the frame 20 for precise movement along the desired arcuate path there defined. Alternatively, the finger might be tractioned to the carriage 25 by means of a coil spring.

Because the proximal phalangeal joint 15 is approximately at the center of the locus of carriage travel, a substantially uniform traction tension is maintained on the middle phalanx at all times. As the carriage 25 travels, the finger 13 generally follows the carriage so as to flex and extend. To insure a full range of movement, the carriage 25 preferably moves about the surface 30 a small distance beyond that which would be necessary to full extend and flex the joint 15 if the finger were more rigidly connected thereto. Accordingly, the axle 46 to which the bands 32 are attached may pivot within the central component 42 to accommodate this extended movement of the carriage 25.

By providing an extended range of carriage movement relative to the finger which is connected thereto by the elastomeric bands 32, the muscles and connective tissues extend or flex to their extreme positions. The finger 13 resists movement in the direction of the pulling force exerted by the carriage 25 through the bands 32 beyond its natural range of flexing and extension.

The device 10 provides for passive motion of finger 13 during healing as the patient engages in normal activities and events as the patient sleeps. At the same time, the finger is held under a predetermined traction to prevent collapse of the fractured. In addition, the device design provides such features so to be more conveniently adapted to a particular patient for being more comfortable to wear, use and transport.

Illustrated in FIG. 6 is an alternative embodiment of a carriage 125 in accordance with the present invention. A frame 130 is provided with a substantially recti-arcuate recess 132 having a groove 134 through which a cable 136 is maintained. The groove 134 is similar to the groove 36 described supra and contains the cable 136 in a manner that allows the cable 136 to reciprocate therein for moving the carriage 125 precisely over the frame 130 for extending and flexing the fractured finger.

The frame 130 provides a track having a pair of rails 131 located symmetrically about the groove 134 to define the recess 132. Each track rail 131 provides an outward cover rail surface 133 upon which the carriage 125 travels. The carriage 125 includes a central fixed component 138 and a pair of roller wheels 140 and 142 rotatably mounted to the central component 138 on an axle 141 for rotation in response to the cable 136. In particular, each of the wheels 140 and 142 rides one of the rail surfaces 133 of one of the rails 131. For rolling on the rail surfaces 133, each of the rollers 140 and 142 includes a rail engaging surfaces 150. The rail engaging surfaces 150 are complementary to the rail surfaces 133. That is, they are inwardly convex for engaging the 133 surfaces and for straddling the rails 131 so as not to shift laterally.

The carriage 125 is rigidly connected to the cable 136 by an attachment member 151 for precise movement therewith the cable 136. A pair of bands 144 attaches the carriage 125 to the fractured finger, as described supra for the prior embodiment, and assists the attachment member to maintain proper contact between the carriage 125 and the rails 131 for effective movement.

The remaining operation and purpose of the alternative embodiment is in accordance with that described above for the first described embodiment of FIGS. 1–5.

Figure 7:
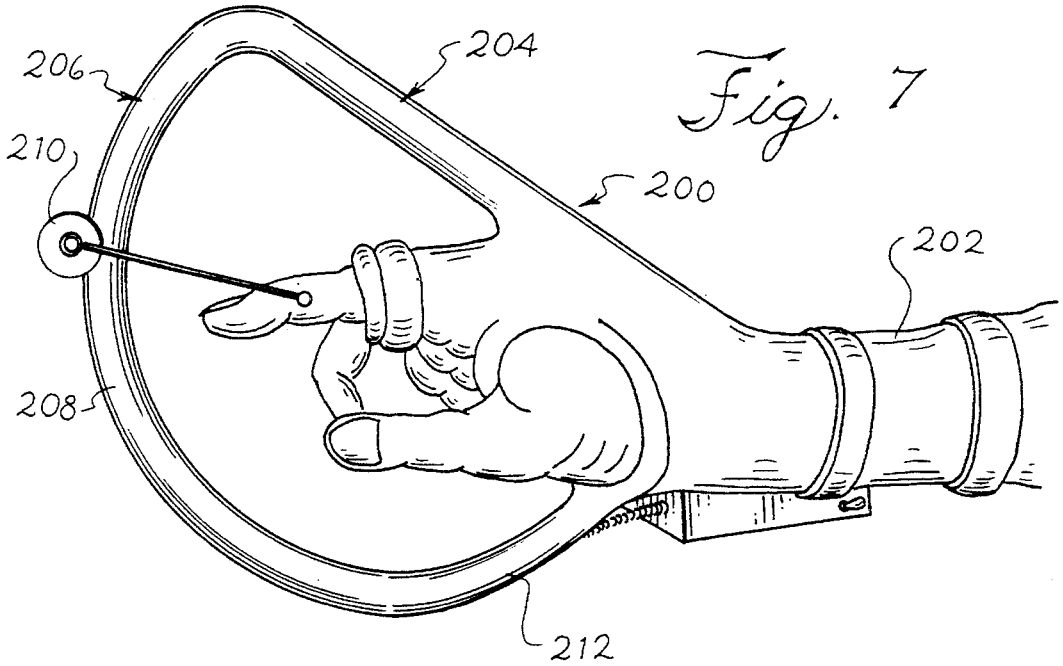
FIG. 7 is a side view of an alternative embodiment of the present invention illustrating an alternative frame or hoop member of the device.

Illustrated in FIG. 7 is an alternative design shape for the hoop of the present invention. This design also is in accordance with the present invention for providing a device which is inexpensive, lightweight, less awkward and less bulky. The construction of the alternative hoop design is that of a partial hoop 200 for reducing the mass outward of the person's fingertips. The partial hoop construction is designed to conform the hoop more to the hand of the patient by reducing unnecessary portions of the hoop while still providing the necessary full extension range for the finger.

The partial hoop 200 comprises a substantially linear portion 204 which turns sharply to continue with a substantially arcuate portion 206. More specifically, the substantially linear portion 204 extends from a splint or half-cast 202 at the back of the hand portion of the cast 202 and is angularly disposed upward from the hand with a predetermined angle beyond the fully extended finger position to provide the finger with more pull in the extensor direction for extending the finger fully. This is often necessary for stiff fingers.

' The substantially arcuate portion 206 extends therearound the hand from the substantially linear portion 204 to the bottom of the cast 202. More particularly, the substantially arcuate portion 206 includes a first portion 208, over which a carriage 210 travels, having a predetermined radius of curvature defining such travel path and a second portion 212 which connects the hoop 200 to the bottom of the cast 202. The substantially arcuate portion 206 is shortened so to provide only the requisite path for the carriage 210 to effectuate full extension of the finger.

For example, the substantially linear portion 204 may extend off the back of the hand with an angle of about 30 degrees beyond the fully extended finger position. This angular disposition gives the substantially arcuate portion 206 the requisite travel length beyond that of the fully extended finger to ensure that the carriage 210 can travel to fully extend the finger in the extensor direction. The first portion 208 of the substantially arcuate portion 206 may include a radius of curvature of about 3 inches for defining the path of travel for the carriage 210. These values are determined by the physician and may be done on a patient-by-patient basis.

The remaining structure and operation and purpose of this alternative hoop design is in accordance with that described for the previously described embodiments of FIGS. 1–6.

Figure 8:
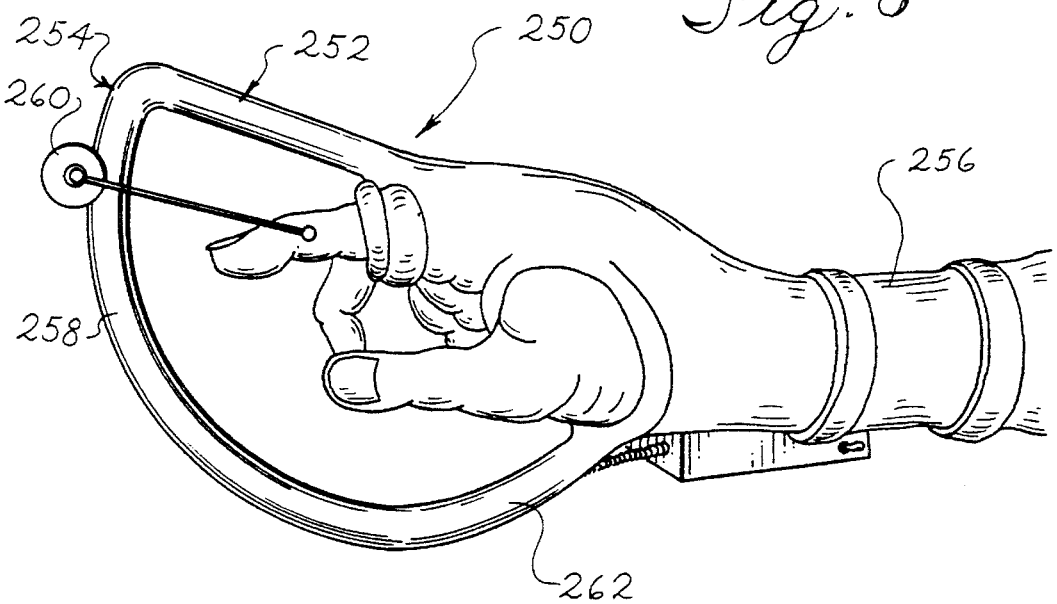
FIG. 8 is a side view of another alternative embodiment of the present invention illustrating another alternative frame or hoop member of the device.

Illustrated in FIG. 8 is another alternative design shape for the hoop of the present invention for providing a device in accordance with the present invention. This alternative embodiment of the hoop also includes a partial hoop 250 for reducing the mass outward of the person's fingertips by conforming it more to the patient's hand.

The partial hoop 250 comprises a substantially linear portion 252 which turns sharply to continue with a substantially arcuate portion 254. More specifically, the substantially linear portion 252 extends from a splint or half-cast 256 at the back of the finger portion of the cast 256 and is angularly disposed upward with a predetermined angle beyond the fully extended finger position to provide the finger with more pull in the extensor direction for extending the finger fully.

The substantially arcuate portion 254 extends therearound the hand from the substantially linear portion 252 to the bottom of the cast 256. More particularly, the substantially arcuate portion 254 includes a first portion 258 over which the carriage 260 travels and has a predetermined radius of curvature defining such travel and a second portion 262 which connects the hoop 250 to the bottom of the cast 256.

For example, the substantially linear portion 252 may extend off the back of the finger at an angle of approximately 30 degrees beyond the fully extended finger, and the first portion 258 of the substantially arcuate portion 254 may include a radius of curvature of about 3 inches defining the path of travel for the carriage 260. These values also are determined by the physician and may be done on a patent-by-patient basis.

The remaining structure and operation and purpose of this alternative hoop design is in accordance with that described for the previously described hoops and carriages of FIGS. 1–7.

From the foregoing, it is seen that the objects hereinbefore set forth may readily and efficiently be attained, and since certain changes may be made in the above construction and different embodiments of the invention without departing from the scope thereof, it is intended that all matter contained in the above description or shown in the accompanying drawings shall be interpreted as illustrative and not in a limiting sense.

What is claimed is:

1. A portable hand-held device for flexing and extending a finger having a fractured bone, the device comprising:

a support including having means for attaching to the hand and arm of a patient;

a frame having an arcuate portion mounted on the support to be carried thereby adapted to be disposed radially outward of the fingertips of the person's hand;

a carriage mounted on the frame for reciprocating travel about the arcuate portion;

at least one band extending from the carriage to the fractured bone to the carriage to alternately flex and extend the proximal joint;

a motor carried by the support for driving the carriage first in one direction and then in a reverse direction along the arcuate portion of the frame;.

an elongated actuating member operatively connected to the motor to propel the carriage for travel in a first direction and to propel the carriage for travel in a reverse direction;

the frame guiding the elongated actuating member in its travel in the forward and reverse direction of travel and having an interior arcuate groove therein;

the interior groove having the elongated actuating member disposed therein;

the elongated, actuating member being a cable which is curved and travels in an interior groove which has an entrance slot opening into the interior groove; and an attachment member attached to the cable and attached to the carriage and extending from the carriage through the entrance slot opening, the entrance slot opening having a width less than the connecting member and attached cable to retain the cable for traveling within the groove.

2. A device in accordance with claim 1 wherein the frame is provided with a partial hoop which includes a linear portion extending from the back of the hand to the the arcuate portion to reduce the size of the frame.

3. A device in accordance with claim 2 wherein the arcuate portion of the frame has a predetermined length which allows the full extension of the finger to enable the carriage means to travel thereabout for effectuating full extension of the finger.

* * * * *

UNITED STATES PATENT AND TRADEMARK OFFICE

CERTIFICATE OF CORRECTION

PATENT NO. :5,472,407

DATED :December 5, 1995

INVENTOR(S) :Robert R. Schenck

It is certified that error appears in the above-indentified patent and that said Letters Patent is hereby corrected as shown below:

Column 10, line 50, delete "having" and insert --a--.

Column 10, line 63 , delete "." (period) after frame.

Signed and Sealed this

Ninth Day of April, 1996

Bruce Lehman

*Attest:*

BRUCE LEHMAN

*Attesting Officer*

*Commissioner of Patents and Trademarks*